US006205793B1

(12) United States Patent
Schimp

(10) Patent No.: US 6,205,793 B1
(45) Date of Patent: Mar. 27, 2001

(54) METHOD AND APPARATUS FOR RECOVERING AND TRANSPORTING METHANE MINE GAS

(76) Inventor: Christopher E. Schimp, 1705 Grayson Rd., Eldorado, IL (US) 62930

( * ) Notice: Subject to any disclaimer, the term of this patent is extended or adjusted under 35 U.S.C. 154(b) by 0 days.

(21) Appl. No.: 09/347,562

(22) Filed: Jul. 6, 1999

(51) Int. Cl.[7] ..... F17C 11/00
(52) U.S. Cl. ..... 62/46.1; 95/148
(58) Field of Search ..... 62/46.1, 46.3; 34/473; 96/143, 148; 502/418

(56) References Cited

U.S. PATENT DOCUMENTS

| | | | | |
|---|---|---|---|---|
| 3,108,445 | * | 10/1963 | Portzer et al. | 62/46.3 |
| 4,749,384 | * | 6/1988 | Nowobilski et al. | 55/27 |
| 5,094,736 | * | 3/1992 | Greenbank | 206/0.7 |
| 5,117,802 | * | 6/1992 | Durbin | 123/577 |
| 5,247,971 | * | 9/1993 | Talu | 141/9 |
| 5,292,707 | * | 3/1994 | Aparicio et al. | 502/418 |
| 5,416,056 | * | 5/1995 | Baker | 502/425 |
| 5,461,023 | * | 10/1995 | Chang et al. | 502/418 |
| 5,626,637 | * | 5/1997 | Baker | 48/127.3 |

FOREIGN PATENT DOCUMENTS

| | | | | |
|---|---|---|---|---|
| 268983 | * | 6/1989 | (DE) | 62/46.3 |
| 201997 | * | 9/1986 | (JP) | 62/46.3 |

* cited by examiner

*Primary Examiner*—William Doerrler
(74) *Attorney, Agent, or Firm*—Don W. Weber

(57) ABSTRACT

A method and apparatus for economically storing and transporting coal mine methane gas is presented. The apparatus utilizes converted propane tankers. Standard propane tankers are filled with activated carbon or commercial carbons with a high volumetric methane adsorption capacity. The methane gas is compressed by a smaller compressor at the well and loaded into the converted tanker. At least three converted tankers are utilized in this method, one being loaded at the well, one discharging its methane gas at the end-user, and one being transported in between the well and the end-user. The truck used to transport the converted tankers has a bi-fuel system adding to the economy of the method and apparatus. Utilizing this apparatus and method of storage and transportation will reduce greenhouse emissions from the mine and from the power plants, and will provide the owner and operator with numerous tax credits and clean air incentives. It also provides the public with a cheaper source of cleaner burning fuel for large public utilities and other large end-users.

2 Claims, 1 Drawing Sheet

METHOD AND APPARATUS FOR RECOVERING AND TRANSPORTING METHANE MINE GAS

BACKGROUND OF THE INVENTION

As coal is mined, a large amount of methane gas accumulates in the coal mines. Sometimes this methane gas is simply burned off. At other times, it is allowed to accumulate. This invention relates to the field of the recovery of methane gas from a coal mine. More particularly, it involves an apparatus and method for economically recovering methane gas from a coal mine and transporting the methane gas to an end user.

Much attention has recently been focused on emission standards, particularly for high volume public utilities such as power plants. Power plants commonly use cofiring boilers to produce electricity. However, much of the coal available in the United States has high contents of Sulfur Dioxide or Nitrogen Dioxide, two substance emissions which are particularly undesirable for the environment. Many environmental regulations require the reduction of the use of high sulfur content coal in public utilities. One alternative to meeting these emission standards is to pay a penalty for such sulfur dioxide emissions. It is an object of this invention to provide an economical alternative to the payment of these environmental penalties due to the burning of Sulfur Dioxide laden coal.

Many coal boilers which provide Sulfur Dioxide, Nitrogen Dioxide, and GHG emissions are currently in use in the United States. However, these boilers may be easily converted to a cofiring system at a low capital cost. This ease of conversion, along with the economic value of the converted system, makes cofiring coal with gas a low risk approach to using coal mine gas as a substitute for coal. Cofiring with gas improves ash quality, reduces slag build-up, and can slightly increase boiler efficiency. The gas fuel input may vary from less than 3% to 100% of the total fuel input, increasing the short term peaking capability of the coal fire burner.

Approximately 370 utility boilers now have cofiring capabilities, many of which are situated near gassy coil mines. Gassy coal mines are coal mines in which a large amount of methane gas exists. The methane gas is adsorbed by the underground coal and seeps out in salvageable quantities.

In order to determine which boilers would be ideal for cofiring with coal mine gas, operators must consider the gas demand and availability, pipeline distances, and boiler conversion costs. Because coal firing is an ideal application for variable quality coal mine gas, the U.S. EPA is researching the economic potential to site new cofired boilers at gassy coal mines to employ coal, coal mine gas, and ventilation air as fuels. One other alternative to siting these boilers at or near gassy coal mines is to develop an economical way to recover the methane gas from the mine and economically transport it to already existing boiler sites.

It is another object of this invention to provide an alternative means of transportation for coal mine gas, involving a set of specially prepared tankers to transport the methane coal mine gas from the mine to the consumption site.

While cofiring gas at cofired industrial and utility boilers is economically compelling, heretofore there have been great difficulties encountered in the transportation of the coal mine gas to suitable end-user facilities. If a method could be devised to economically capture coal mine gas into tanks and if transportation costs could be held down, the economics of the use of coal mine gas would be greatly increased.

In addition, emission credits and avoided penalties could substantially improve the economics of most coal mine gas projects, thereby stabilizing coal use for utilities. It is a still further object of this invention to provide a suitable means of transportation for recovered coal mine gas which partially uses the coal mine gas recovered as fuel for the transportation means.

Different methods have previously been devised to recover and transport the coal mine gas. For example, the 1982 patent issued to Hvizdos disclosed a Method and Apparatus for the recover and removal of natural gas from a mine by liquefying and collecting the gas within the mine and then transporting the liquified gas to the surface in a mobile tank. However, one drawback in the Hvizdos's method and apparatus is that it utilizes cryogenic liquid for condensing the coal mine gas. Such a cryogenic apparatus would be expensive to acquire and to use. It is a still further object of this invention to provide a method and apparatus for recovering coal mine gas without the necessity of using an expensive cryogenic super cooled liquid.

A major problem with the collection of coal mine gas is that methane cannot be economically collected for transport because the coal mines in which the gas exists are spread out over a large area. The large area would require miles of pipeline. However, existing utility pipelines cannot be used because the nitrogen and carbon dioxide levels in the methane gas are too high for pipeline gas quality. Further, methane will not liquify like propane gas unless it is frozen to 210 degrees below zero by use of cryogenics. As noted above, the cryogenic solution is quite costly.

While the use of existing pipelines is impractical, existing commercially available propane tankers could be modified to fit the needs of this particular industry. In order to utilize these existing propane tankers, certain modifications must be made to the tankers, most importantly including filling the tanker with activated carbons made from coal or commercial carbons not made from coal but with a high volumetric methane adsorption capacity. The activated carbons would adsorb the natural gas and make the gas transportation more economical.

In addition, if the methane is introduced into the propane tankers containing the activated carbons under preferred pressure conditions, the amount of methane that can be delivered would also make the method and apparatus economically viable. It is a still further object of this invention to provide an apparatus for transporting methane gas in modified propane tankers, which makes the transportation economically viable. Other and further objects of this invention will become obvious upon reading the below described Specification.

BRIEF DESCRIPTION OF THE DEVICE

An apparatus for the collection of methane gas is disclosed, utilizing readily available commercial propane tankers, activated carbon, and a small compressor. The use of standard propane tankers for the transportation of methane gas is made economically feasible by placing activated carbon inside the tanker. This activated carbon will absorb methane gas introduced into the tanker, making it much more economical to transport the gas. A small compressor is used at the mine to compress the methane gas and pressurize it to approximately 250 psi. The compressed and pressurized methane gas is then introduced into the propane tanker and absorbed by the activated carbon.

In order to make this particular apparatus economically viable, three or more converted tankers with activated carbon are utilized. The first tanker is loaded at the well site by use of the 250 psi compressor. The methane gas is loaded into the tanker and absorbed by the activated charcoal. As the first tanker is being transported to the end-user utility plant, a second tanker is utilized to begin loading at the well site. Once the operation has commenced, a third tanker would be discharging its gas at the end-user facility. By using three or more tankers in combination, the entire process can be made economically feasible. The use of multiple tankers also overcomes the heat transfer problem of fast loading and unloading of the gas to and from the activated carbons, and enables the tankers to collect the methane gas at the wells without depleting the well.

In addition, the truck used to haul each trailer can be easily modified to run on methane gas, creating additional economic savings and environmental advantages.

DETAILED DESCRIPTION OF THE PREFERRED EMBODIMENT

Figure 1:
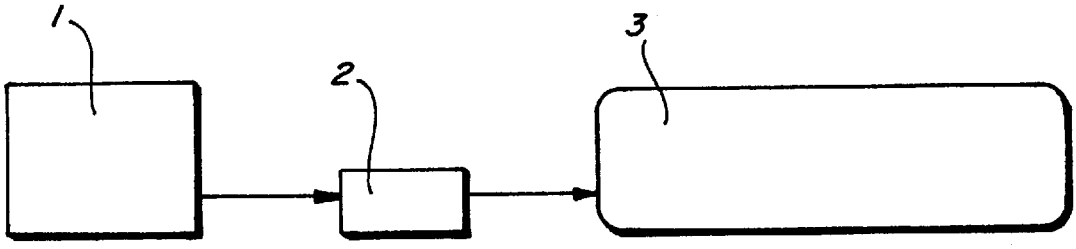
FIG. 1 is a schematic representation of a coal mine well, compressor, and converted methane tanker.

In many coal mines, commonly known in the trade as gassy coal mines, methane gas is accumulated. This methane gas is generally absorbed in the coal located in the mine itself. However, once the methane gas reaches a certain concentration, the methane gas will no longer absorb into the coal but rather filters through the mine and out into the atmosphere. These methane gas emissions from coal mines are quite detrimental to the environment and have been the subject of much investigation and regulation in the environmental protection area. With new clean air standards becoming even more stringent, it is highly desirable to capture this escaping methane gas and put it to a useful purpose. There are a number of methods used to capture the methane gas as disclosed in the prior art. However, the concentration of this methane gas for transportation, as well as the means for economically keeping the flow of methane gas to an end-user, have not heretofore been devised. This invention utilizes existing technology to compress and transport methane gas in an economical manner.

The instant system utilizes existing propane transport tankers. These tankers are very much in abundance in the United States and throughout the World. They can easily transport methane gas under a pressure of 250 psi. The tankers are readily available thus allowing for a low capital investment cost with no expensive special equipment required. One element of the invention is to utilize existing propane tankers but to convert them for the transportation of methane gas as described further below.

The propane tankers to be converted are filled with activated carbons made from coal or commercial carbons not made from coal but with a high volumetric methane adsorption capacity. This technology is well-known in the prior art and proven for the development of natural gas to be used on board motor vehicles as a fuel in place of gasoline or diesel fuel. However, the natural gas/activated carbon technology developed for on-board motor vehicle use requires an expensive high pressure system and hence is now in little demand. Although the activated carbon and high pressure reduces the mass of the storage cylinders required, the pressures are quite high and safety risks become an important consideration. In addition, pressurizing methane gas to very high pressures requires costly equipment.

Another way to reduce the mass of the storage cylinders, involving less demanding safety requirements and a reduced cost of compression and station storage, is involved in the methane gas recovery and storage. In order to be economically feasible for use on motor vehicles, a pressure of 500 psi is necessary, requiring specially built strong containers. At 500 psi, and with the use of activated carbons, the achievable adsorbed storage is three times the unpacked storage. In other words, three cubic feet of unpacked gas could be stored in one cubic foot of the container, utilizing activated carbons and 500 psi. However, a ratio of 5 to 1 rather than 3 to 1 is needed to be attractive for commercialization, at relative pressures.

At lesser pressures, it has been found that more gas storage can be obtained. Utilizing the propane tankers, which are designed for 250 psi with activated carbons, adsorbed storage of four times the unpacked storage may be achieved. This four to one ratio is economically feasible for the transportation of methane gas.

In actual operation, mine gas is collected at the mine site and is compressed to 250 psi by a small, highly portable compressor located at each well where the gas is to be loaded. If any well dries up, the compressor and loading system can easily be moved to the next well, therefore eliminating any stranded cost in the utilization of this particular method.

As best shown in FIG. 1, the coal mine collection area or well 1 loads the collected coal mine gas into the small compressor 2. The compressor compresses the methane gas to approximately 250 psi and then loads the compressed gas into the specially converted tanker 3. This specially converted tanker 3 is filled with activated carbon. The combination of the methane gas compressed to approximately 250 psi and the activated carbon makes the collection, storage and transportation of the methane gas from the mine to the end-user site economically feasible, when used in conjunction with the three tankers as described below.

Because the pressures utilized in this method are small (approximately 250 psi) economical compressors can be located at each well where the methane gas is to be collected, stored, and transported. If any well dries up, the loading system can easily be moved to the next well, therefore eliminating any stranded cost in the compressing and loading system.

In order to make this particular method even more economically viable and to overcome the heat transfer problem associated with activated carbons with fast loading and unloading the methane gas, a truck is utilized in conjunction with three converted tanker trailers in a consecutive fashion. The carbons will heat up when they adsorb methane too fast causing them to adsorb less methane. The carbons will cool down when they disadsorb too fast causing them not to disadsorb or release the methane gas.

Figure 2:
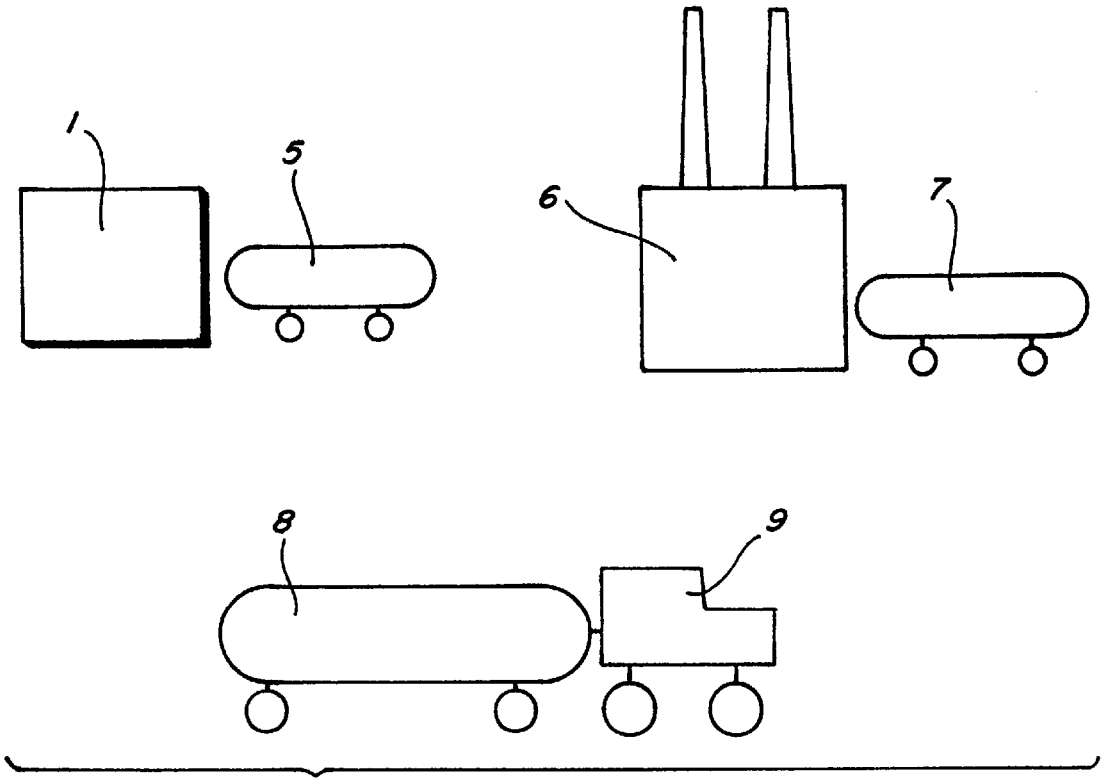
FIG. 2 is a schematic representation of the three tanker method of use disclosed.

As best shown schematically in FIG. 2, a first converted tanker 5 is utilized at the collection or loading site 1 of the coal mine. The first loading tanker 5 is placed at the source of the methane gas. The methane gas is compressed and loaded into the first loading tanker 5.

If methane gas is collected from a coal mine at too great a rate, the remaining methane gas will not disadsorb from the coal fast enough and the well will essentially run dry of methane gas. The desadsorption rate of gas from the coal is a critical factor to be considered. It has been found that the optimal loading rate at the well 1 into the loading tanker 5 is 16,000 cubic feet of methane per hour for six hours. This will load approximately 100,000 cubic feet of methane into the loading tanker while still keeping the methane available from the mine at an appropriate level. 400,000 cubic feet may be loaded per day.

If, for example, the methane gas is loaded in one hour rather than six hours, too much heat would be generated from the adsorption process in the activated carbons, causing the activated carbons to lose its ability to adsorb more methane. Further, loading in one hour can cause the well or coal mine to be exhausted much sooner than desirable. It has been found that the loading rate for a tanker should be less than 50,000 cubic feet of methane gas loaded or unloaded per hour. This allows the temperature of the activated carbon to remain low enough for efficient loading at maximum capacity.

If methane gas is loaded under the above conditions in two hours, the activated carbons will not overheat. However, if methane is loaded in less than six hours, the rate of loading could damage the well supply. Therefore, the preferred loading time is six hours, rather than 2, at a rate of 16,000 cubic feet per hour. Additional tankers could be utilized at additional wells in the vicinity to further enhance the efficiency of this process.

Located at the power plant, utility, or other end-user 6 of methane gas is a second discharging tanker 7. This discharging tanker will have been transported from the original well source 1. The discharging tanker 7 should be discharged in approximately two hours. This means that the tanker will be discharging approximately 50,000 cubic feet per hour. At this rate the activated carbons will not cool too quickly. (Cooling too quickly would inhibit the disadsorption or release of the methane gas.) All of the tankers utilized in this device are converted propane tankers, filled with activated carbon or commercial carbons not made from coal with a high volumetric methane adsorption capacity, and loaded at 250 psi.

Being transported between the first loading tanker 5 and the second discharging tanker 7 is a third delivering tanker 8. This tanker would normally be on the road between the well 1 and the end-user facility 6. This third delivering tanker 8 is transported by the converted truck 9, shown schematically in FIG. 2.

The converted truck 9 is yet another means for making the entire apparatus and process more economical. The trucks 9 can operate on a 24 hour a day basis. To maintain low fuel consumption and maintenance costs, the trucks should be set up on a bi-fuel system, using some of the methane gas collected at the well 1 as part of the truck's fuel. The technology involved in a bi-fuel system is well-known in the prior art.

Natural gas has been utilized to operate with diesel fuel to reduce the fuel cost and maintenance of a vehicle because the engine runs cleaner and more efficiently with bi-fuel systems. The mined methane gas will operate in the same fashion in the truck engine as natural gas, thus utilizing the methane gas to reduce the transportation costs and making the system even more economical.

The methane gas is loaded onto the truck into a tank different from the diesel fuel tank when it returns to the gas well. The bi-fuel system is a very simple kit that is fitted onto any truck where the air intake of the engine is fumigated with methane and then pulled into the combustion area of the engine along with the diesel fuel. When the diesel fuel ignites the methane is ignited along with it. The truck will then operate using approximately 75% methane and 25% diesel fuel. To further the economic viability of this system, it should be noted that the Federal Government allows a $50,000.00 tax credit for every truck fitted with a bi-fuel system. A 20 cents per gallon savings from the road fuel tax is also added onto the economy of this system.

In order to make this particular system most efficient, each bi-fuel truck 9 is teamed up with three converted tanker trailers 5, 7 and 8. The first tanker trailer 5 is being loaded and pressurized at the well, while the second tanker trailer 7 is discharging its load at the end-user's facility 6. The third tanker trailer is being transported between the well 1 and the enduser 6. When the transported trailer 8 arrives at the end-user 6, it hooks up to the facility's manifold to begin unloading. The truck 9 is then unattached to the third delivering tanker 8 and hooked up to the second discharged tanker 7 once the discharged tanker 7 is empty.

The truck then transports the empty trailer to the well and picks up the loading tanker that has been pressurized and loaded while the truck was delivering to the end-user. The system is easily set up such that the discharging trailer 7 can be unloaded at the end-user by the time the truck makes the round trip with the unloaded tanker and returns with the loaded tanker from the well. If the end user needs more gas before the truck can make the round trip between the end-user and the well, another truck can be put into the system and teamed up with the three transport tankers. Further the compressors can be designed to load the gas into the tankers at the necessary cubic feet volume to accommodate the enduse's need and the capacity of the well. If more gas is needed, a one truck system can be teamed up with any combination of compressors and wells. This system is thus very versatile and can utilize different combinations of trucks and converted tankers to fit the end-user's needs as well as the well's capacity.

Although the economies of the utilization of this system may vary, an abbreviated discussion of the dollar amounts involved is quite revealing. Methane may be sold at $1.50 per 1,000 cubic feet (MCF). This is 25 to 50% cheaper than natural gas. Greenhouse emission credits for methane are now worth approximately 40 cents per MCF so that an additional $40 of revenue per truckload (100 MCF) in two hours can be obtained from emission credits alone. Factoring in the federal tax credit of $50,000.00 for the truck being fitted with the bi-fuel system, the total revenue for one truckload of methane would be approximately $188.00. Subtracting out the operating costs, the net income from one load of methane would be approximately $70.00 per load.

The total system net income from four trucks operating four loads at two hours each per year would yield a net income of approximately $1 Million. Obviously, this apparatus and system would not only be economically viable when put in place; it would also be of great benefit to the environmental emissions systems and would promote clean air wherever this system was used.

It has been found that the approximate pressures and discharge rates are most desirable and represent the preferred embodiment. However, loading pressures of slightly greater or slightly less than 250 psi would still be within the spirit and disclosure of this invention. In addition, four converted tankers or more could be used in this method, depending on the output of the well and the requirements of the end user. And while large power plants and public utilities would be the preferred end users in this apparatus and method, other end-users are still within the contemplation and disclosure of the method and apparatus herein.

Having fully described my device, I claim:

1. A method of loading methane gas from a well and delivering and discharging methane gas at an end-user, comprising the steps of:

(a) loading a first tanker with between 5,000 and 16,000 cubic feet of methane gas per hour for approximately six hours, compressed to approximately 250 psi, wherein said first tanker is filled with activated charcoal or commercial carbons with a high volumetric methane adsorption capacity, whereby the commercial carbons of said first loading tanker will not inefficiently heat up during the loading process;

(b) discharging said compressed methane gas at an end-user from a second tanker, at a rate of discharge of approximately 50,000 cubic feet per hour, wherein said second tanker is filled with activated carbon or commercial carbons with a high volumetric methane adsorption capacity, whereby the commercial carbons of said second discharging tanker will not inefficiently cool down too quickly during the discharging process;

(c) transporting at least one other tanker filled with methane gas between said well and end-user during the time that said first tanker is loading and said second tanker is discharging wherein said other tanker is filled with activated charcoal or commercial carbons with a high volumetric methane adsorption capacity, whereby a discharge tanker may be transported between said end-user and said well while another tanker is being efficiently loaded at said well and yet another tanker is being efficiently discharged at said end-user.

2. A method for collecting, compressing, storing and transporting methane well gas as in claim 1, further comprising the step of using a bi-fuel truck utilizing methane gas and diesel fuel to transport said tankers between the well and end-user.

* * * * *